US007057344B2

(12) United States Patent
Fujitani

(10) Patent No.: US 7,057,344 B2
(45) Date of Patent: Jun. 6, 2006

(54) PLASMA DISPLAY PANEL

(75) Inventor: Morio Fujitani, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/501,137

(22) PCT Filed: Jan. 21, 2004

(86) PCT No.: PCT/JP2004/000462

§ 371 (c)(1),
(2), (4) Date: Jul. 13, 2004

(87) PCT Pub. No.: WO2004/066341

PCT Pub. Date: Aug. 5, 2004

(65) Prior Publication Data

US 2004/0256990 A1 Dec. 23, 2004

(30) Foreign Application Priority Data

Jan. 24, 2003 (JP) ..... 2003-015871

(51) Int. Cl.
*H01J 17/64* (2006.01)

(52) U.S. Cl. ..... 313/587; 313/585

(58) Field of Classification Search ..... 313/581–587; 315/169.4; 345/37, 41, 60
See application file for complete search history.

(56) References Cited

U.S. PATENT DOCUMENTS 6,261,144 B1 * 7/2001 Nishiki et al. ..... 445/24
6,674,236 B1 * 1/2004 Awaji et al. ..... 313/587

FOREIGN PATENT DOCUMENTS

| | | |
|---|---|---|
| JP | 3-20926 | 1/1991 |
| JP | 4-269420 | 9/1992 |
| JP | 5-41167 | 2/1993 |
| JP | 9-50769 | 2/1997 |
| JP | 9-259768 | 10/1997 |
| JP | 10-199403 | 7/1998 |
| JP | 2002-343237 | 11/2002 |

OTHER PUBLICATIONS

Naotaka Kosugi, "Dielectric Layer Forming Technology", 2001 FPD Technology Outlook, P 594-597.

* cited by examiner

*Primary Examiner*—Ashok Patel
(74) *Attorney, Agent, or Firm*—Wenderoth, Lind & Ponack, L.L.P.

(57) ABSTRACT

A plasma display panel is provided which is free from blisters and pinholes on its dielectric layers and has excellent characteristics of breakdown voltage. The plasma display panel has a multilayered first dielectric layer covering a display electrode including a scanning electrode and a sustain electrode that are provided on a front substrate, and a multilayered second dielectric layer covering a data electrode that is provided on a back substrate. The periphery of an upper dielectric layer of the first dielectric layer and/or the second dielectric layer is positioned identically or partially in size and shape to a periphery of a lower dielectric layer to be formed.

1 Claim, 3 Drawing Sheets

PLASMA DISPLAY PANEL

TECHNICAL FIELD

The present invention relates to a plasma display panel that is known as a display device.

BACKGROUND ART

A plasma display panel displays images by exciting a phospher with ultraviolet light generated by gas discharge for light emission.

A plasma display device using such a plasma display panel has a higher display quality than a liquid crystal panel with regard to features including a high-speed display capability, a wide viewing angle, easy upsizing, and a self-luminous property. Thus, the plasma display panel especially attracts attention among flat-panel displays these days, and is used in various applications such as a display device for a location where many people gather or for enjoying a large-screen image at home.

A plasma display panel is roughly classified into an AC type and DC type by driving method, and a surface-discharge type and opposed-discharge type by discharging type. In terms of moving to finer-resolution, increasing size of a screen, and the simplicity of the structure, a plasma display panel with a three-electrode structure, that is, a surface-discharge type and AC type, prevails. An AC-type plasma display panel is composed of a front panel and a back panel. The front panel, which is equipped with display electrodes that are composed of scanning electrodes and sustain electrodes on the front substrate (a glass substrate), forms a first dielectric layer covering the display electrodes. Meanwhile, the back panel, which is equipped with providing at least a plurality of data electrodes that are orthogonal to the display electrodes on the back substrate (a glass substrate), forms a second dielectric layer covering the data electrodes. Arranging the front panel and the back panel as facing each other forms discharge cells at the interception points of the display electrodes and data electrodes, and also provides phospher layers in the discharge cells.

In the structure of such a plasma display panel, an example for a multilayered structure of the first dielectric layer and/or second dielectric layer is disclosed in the FPD Technology Outlook 2001 (Electronic Journal, Co., Oct. 25, 2000, pp. 594–597) for example. Its objective includes using a material with a high glass softening point for the lower layer, and a low glass softening point for the upper layer for example, covering defects such as pinholes that are generated while forming the lower layer, on the upper layer, thereby improving the breakdown voltage. Also, these dielectric layers are formed not in a single coating but in laminating several times for a certain thickness, which will result in a favorable surface roughness.

However, in some cases, although these dielectric layers are formed in the above-mentioned way, convex blisters formed on the surface cause the surface roughness to be unfavorable, or pinholes which are generated decrease the breakdown voltage.

As a result of research on these problems conducted by the present inventor, the following facts have been found. FIGS. 5, 6, and 7 are sectional views schematically illustrating conditions of the end part of the dielectric layer when a dielectric material with such a conventional laminated structure is formed, where the first dielectric layer formed on the front panel is shown as an example. The description is made for an example where, as shown in FIG. 5, on a front substrate 23, a first dielectric layer 27 is composed of two layers, i.e. a lower dielectric layer 27*a* and an upper dielectric layer 27*b*. If the upper dielectric layer 27*b* is formed with the periphery of the lower dielectric layer 27*a* covered, a bubble 101 is involved between the periphery of the lower dielectric layer 27*a* and the upper dielectric layer 27*b*. In such a case, as shown in FIG. 6, this bubble 101 expands in a subsequent baking process, causing a blister 102 to occur on the first dielectric layer 27. In addition, as shown in FIG. 7, burst blisters cause a pinhole 103 to occur on the upper dielectric layer 27*b*, resulting in a deterioration of the performance of breakdown voltage of first dielectric layer 27. This problem is also found in the second dielectric layer provided in the back panel.

The present invention has been made from these situations and to solve the above problems. Accordingly, an object of the present invention is to implement a plasma display panel enabling a favorable image display and having dielectric layers with a multilayered structure that prevents bubbles from being contained.

SUMMARY OF THE INVENTION

A plasma display panel of the present invention includes a multilayered first dielectric layer for covering a display electrode, which is provided on a front substrate and formed of a scanning electrode and a sustain electrode, and a multilayered second dielectric layer for covering a data electrode which is provided on a back substrate. A periphery of an upper dielectric layer of the first dielectric layer is positioned identically or partially in size and shape to a periphery of a lower dielectric layer of the first dielectric layer, and/or a periphery of an upper dielectric layer of the second dielectric layer is positioned identically or partially in size and shape to a periphery of a lower dielectric layer of the second dielectric layer. This structure enables implementation of a plasma display panel with dielectric layers with an excellent characteristic of breakdown voltage, by preventing bubbles from being generated on the periphery of the dielectric layers.

DETAILED DESCRIPTION OF THE PREFERRED EMBODIMENT

The following section describes a plasma display panel as one embodiment of the present invention with reference to the drawings.

Figure 1:
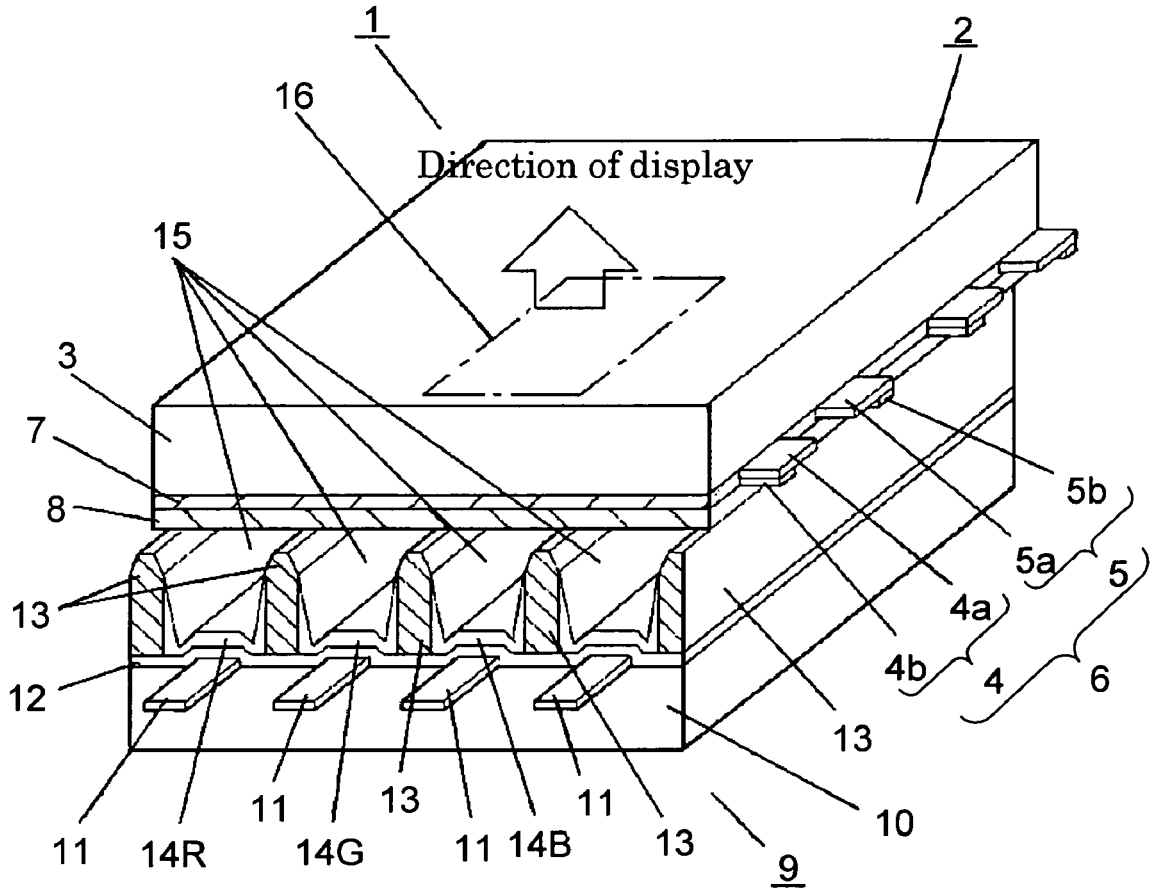
FIG. 1 is a sectional perspective view schematically showing the configuration of a plasma display panel as one embodiment of the present invention.

FIG. 1 is a sectional perspective view schematically showing the configuration of a plasma display panel as one embodiment of the present invention.

As illustrated in FIG. 1, a PDP (plasma display panel) 1 is composed of a front panel 2 and a back panel 9. The front panel 2 is equipped with, on a substrate 3 such as a transparent and insulating glass substrate, a display electrode(s) 6 composed of a scanning electrode 4 and a sustain electrode 5, a first dielectric layer 7 covering display electrode 6, and a protective layer 8 made of an MgO film covering the first dielectric layer 7. In this case, the scanning electrode 4 and the sustain electrode 5, aiming at securing transparency and reducing electrical resistance, have a structure wherein bus electrodes 4*b* and 5*b* made of a metallic material are laminated on transparent electrodes 4*a* and 5*a* for example. Further, the first dielectric layer 7 is formed in the following way: A front substrate 3 is coated with a dielectric material paste containing low-melting-point glass powder by using screen printing or die coating, or alternatively a precursor material layer made of a sheet-like dielectric material formed on a transfer film is transferred and sealed on the respective substrates, and then baked.

The back panel 9 is formed of a data electrode(s) 11 and a second dielectric layer 12 for covering the data electrode(s) 11, both of which are disposed on a back substrate 10 such as an insulating glass substrate, for example. Further, a barrier rib 13 which is parallel to the data electrode 11 is formed on the second dielectric layer 12, and phosphor layers 14R, 14G, and 14B are provided on the surface of the second dielectric layer 12 and on the side of the barrier rib 13. Here, the second dielectric layer 12 is formed in the same way as for first dielectric layer 7 as follows: the back substrate 10 is coated with a dielectric material paste containing low-melting-point glass powder by using screen printing or die coating, or alternatively a precursor material layer made of a sheet-like dielectric material formed on a transfer film is transferred and sealed on the respective substrates, and then baked.

The front panel 2 and the back panel 9 are arranged so as to be facing each other with discharge space 15 intervening therebetween so that the display electrode 6 and the data electrode 11 are orthogonal to each other, and are sealed with a sealing member formed on the periphery thereof. At least one kind of noble gas out of helium, neon, argon, or xenon is filled as a discharge gas in the discharge space 15. The discharge space 15 is partitioned by the barrier rib 13, and the discharge space 15 at the interception of the display electrode 6 and data the electrode 11 works as discharge cell 16.

Figure 2:
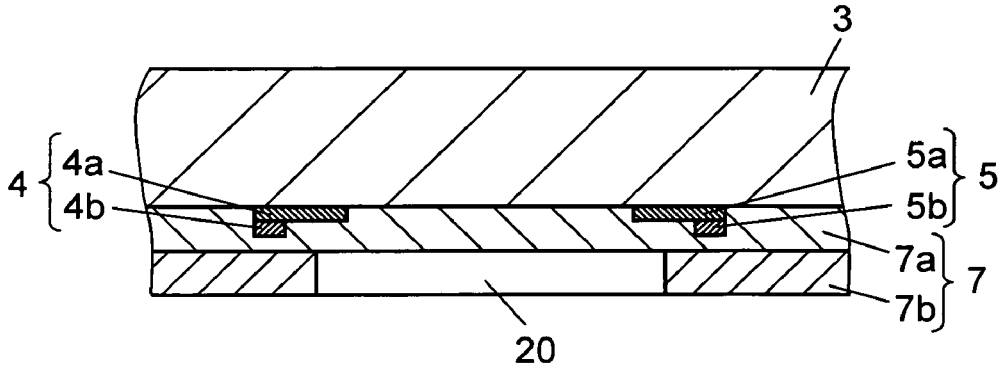
FIG. 2 is a sectional view showing another structure of the front panel of the plasma display panel.

The characteristic points of the plasma display panel in the above-mentioned embodiment of the present invention are as follows. The first dielectric layer 7 and/or the second dielectric layer 12 are in a multilayered structure, and also each upper layer is arranged so as not to cover the periphery of the lower layer. The first objective of making the first dielectric layer 7 and/or the second dielectric layer 12 a multilayered structure is, for example, by using a material with a high glass softening point for the lower layer, and a low softening point for the upper layer, to cover defects such as pinholes that are generated on the lower layer, by the upper layer, thereby improving the breakdown voltage. Another objective is, by laminating and coating the first dielectric layer 7 and/or the second dielectric layer 12 several times for a certain thickness, to make the surface roughness favorable. Further, as shown in FIG. 2, which is a sectional view of the front panel 2, in the discharge cell 16, the first dielectric layer 7 is in a two-layer laminated structure with a lower dielectric layer 7*a* and an upper dielectric layer 7*b*, and the upper dielectric layer 7*b* includes a hole 20, thereby enabling the first dielectric layer 7 to have a recess corresponding to the discharge cell which can be formed easily.

Figure 3:
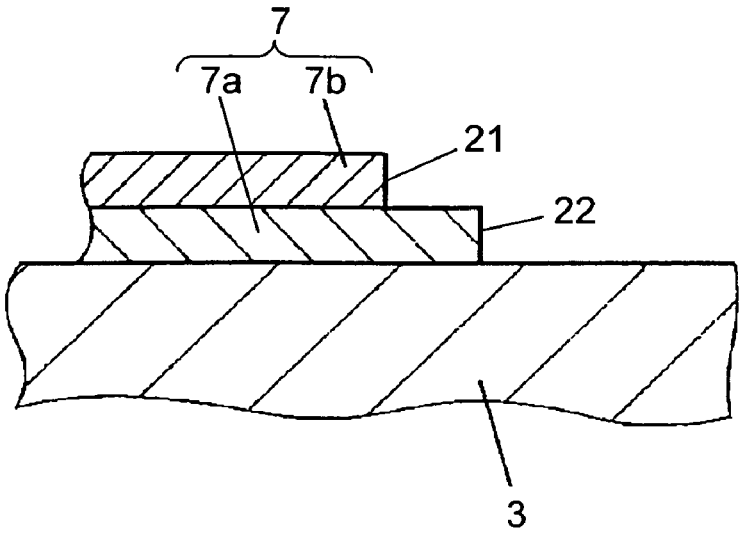
FIG. 3 is a sectional view schematically showing the configuration at an end of the front panel of the plasma display panel.
Figure 5:
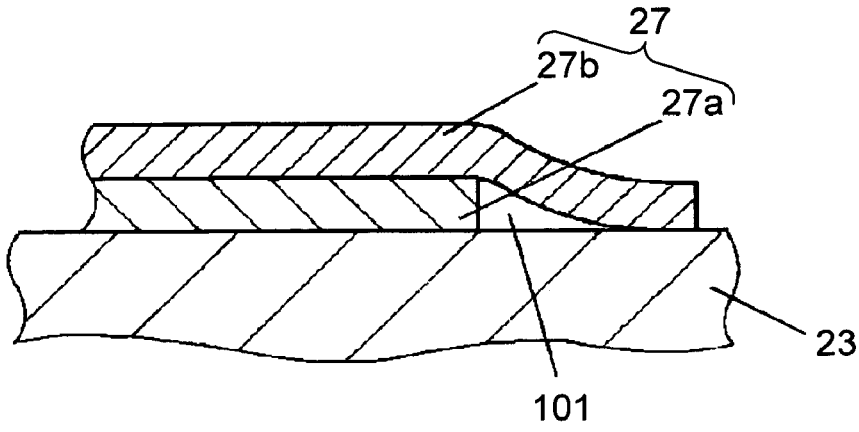
FIG. 5 PRIOR ART
FIG. 5 is a sectional view typically showing a condition of a dielectric layer end when a dielectric layer with a conventional laminated structure is formed.
Figure 6:
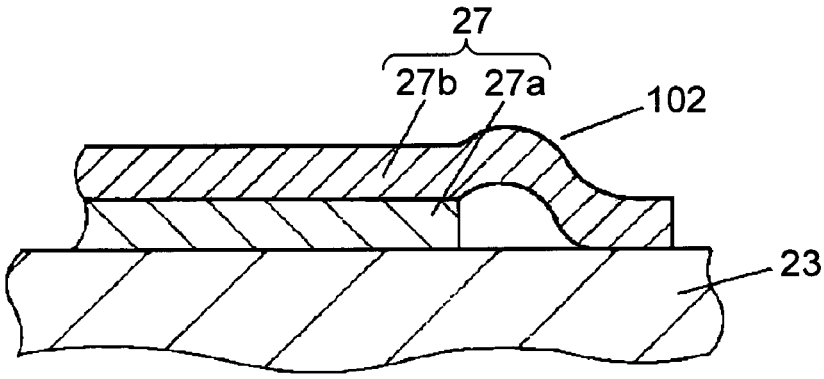
FIG. 6 PRIOR ART
FIG. 6 is a sectional view typically showing the condition of a dielectric layer end after baking when a dielectric layer with a conventional laminated structure is formed.
Figure 7:
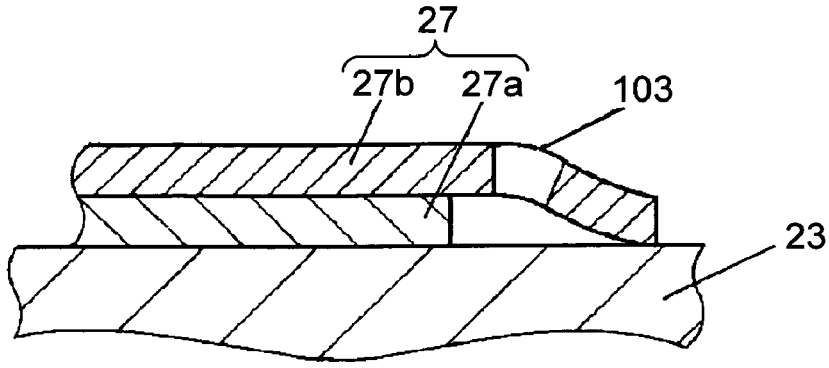
FIG. 7 PRIOR ART
FIG. 7 is a sectional view typically showing the condition of another dielectric layer end after baking when a dielectric layer with a conventional laminated structure is formed.

FIG. 3 schematically shows a sectional view for the configuration at the end of the front panel 2 of the PDP 1 in the embodiment of the present invention. FIG. 3 illustrates the front substrate 3 and the first dielectric layer 7 only for simplicity of the description, and a case of a two-layer structure. As shown in FIG. 3, in the present invention, a periphery 21 of the upper dielectric layer 7*b* of the first dielectric layer 7 is positioned identically or partially in size and shape to the periphery 22 of the lower dielectric layer 7*a* to be formed, Thereby preventing the upper dielectric layer 7*b* from covering the periphery of the lower dielectric layer 7*a*. This enables restricting bubbles that would be involved if the upper dielectric layer 7*b* covered the periphery of the lower dielectric layer 7*a*, as shown in FIG. 5. As a result, blisters and pinholes supposedly caused by contained bubbles and the consequent defect in breakdown voltage can be prevented from occurring in the first dielectric layer 7.

In addition, although a case of a two-layer structure is described in this embodiment, even for a multilayered structure with two or more layers, as long as the upper dielectric layer is structured so as not to cover the lower dielectric layer, the same advantage can be achieved, as well as for the second dielectric layer 12 of the back panel 9.

The method for forming first the dielectric layer 7 mentioned above will now be described.

The following method is given as a first example. First of all, after coating the front substrate 3 with a dielectric material paste containing low-melting-point glass powder, a binding resin and a solvent, by using a screen printing plate for the lower dielectric layer 7*a*, the paste is dried to form the lower dielectric layer 7*a*. Next, after coating the lower dielectric layer 7*a* with the paste by using a screen printing plate for upper dielectric layer 7*b*, the paste is dried, and then, a precursor of the two-layer first dielectric layer 7 is formed. In this case, the screen printing plate for the upper dielectric layer 7*b* is smaller than screening printing plate for the lower dielectric layer 7*a*, and the periphery 21 of upper dielectric layer 7*b* is arranged identically or partially in size and shape to the periphery of lower dielectric layer 7*a* with appropriate positioning. With screen printing in this way, the periphery 22 of the lower dielectric layer 7*a* is not covered with the upper dielectric layer 7*b*. Then, the precursor is baked to form two-layer first dielectric layer 7. In baking, the precursor is left for a few to several tens of minutes at a temperature that is higher than the softening point of the low-melting-point glass powder contained in the precursor of the first dielectric layer 7 after it is dried. The baking changes the precursor of the first dielectric layer 7 to the first dielectric layer 7. Baking may be performed every time the lower dielectric layer 7*a* and the upper dielectric layer 7*b* are coated and dried respectively, or at one time after both of them are coated and dried.

The following method is given as a second example. After coating the front substrate 3 with a dielectric material paste containing low-melting-point glass powder, a binding resin, a photosensitive material and a solvent, by using die coating, the paste is dried to form a precursor of the first dielectric layer 7, and then the precursor is baked. Also, in this case, when die-coating the upper dielectric layer 7*b*, in order for the upper dielectric layer 7*b* not to cover the periphery of the lower dielectric layer 7*a*, the area to be coated by a die coater and the positioning need to be appropriate. The same method applies to baking.

The following method is given as a third example. After coating a supporting film with a dielectric material paste containing low-melting-point glass powder, a binding resin, a photosensitive material and a solvent, the paste is dried to make a transfer film formed as a dielectric film. Next, the dielectric film is transferred and laminated from the transfer film onto a substrate to form a precursor of the multilayered first dielectric layer 7, and the precursor is then baked. Also, in this case, in order for the layer to be transferred as the upper dielectric layer 7*b* and not to cover the periphery of the layer which is transferred as the lower dielectric layer 7*a*, the size of the dielectric film formed on the transfer film and the accuracy in transfer position need to be adjusted appropriately. In this case, when transferring the dielectric film from the transfer film, because the dielectric film is like a sheet, if the upper dielectric layer 7*b* is transferred so that it covers the periphery 22 of the lower dielectric layer 7*a*, a lot of bubbles will be involved. This means applying the present invention will notably achieve a great effect.

Here, the transfer film is formed as follows. After coating a supporting film with a photosensitive dielectric paste by using a roller coater, blade coater, curtain coater, or the like, the paste is dried and then a part or the entire aforementioned solvent is removed. Then, pressing a cover film over it to bond completes the production. The transfer process wherein the dielectric film is transferred from the transfer film to the substrate is as follows. After detaching the cover film from the transfer film, lap the transfer film over the substrate surface so that the dielectric film contacts the substrate surface, thermocompress over the transfer film using a heating roller, and then detach the supporting film. Such an operation is performed by a laminating device. Further, after exposing the precursor of first dielectric layer 7 formed on the substrate to the irradiation of ultraviolet light through a certain form of mask, the development enables the size of the periphery of lower dielectric layer 7*a* and the upper dielectric layer 7*b* to be controlled. In baking, the precursor is left for a few to several tens of minutes at a temperature that is higher than the softening point of the low-melting-point glass powder contained in the precursor of the first dielectric layer 7. This operation enables the precursor of the first dielectric layer 7 to be changed to the first dielectric layer 7 with a desirable size and shape.

Figure 4:
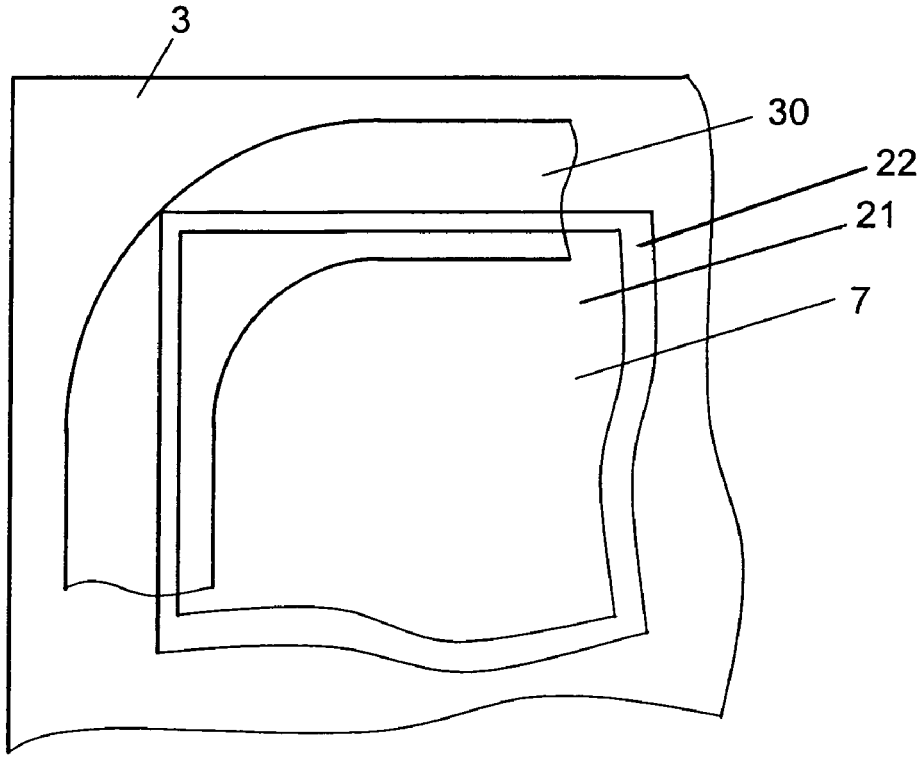
FIG. 4 is a plan view showing the positional relation between a first dielectric layer and a sealing member of the plasma display panel.

FIG. 4 is a plan view showing the positional relationship between the first dielectric layer 7 and the sealing member 30 of the plasma display panel. As shown in FIG. 4, if the periphery of the first dielectric layer 7 is covered with the sealing member 30, bubbles are involved in the periphery as in the conventional plasma display panel, and blisters and burst parts are generated, and therefore, the distance is affected between the front glass substrate 3 and the back glass substrate 10 arranged so as to be facing each other with the sealing member 30 intervening therebetween. Consequently, a crosstalk and a noise (buzz) during display of images may occur. However, applying the present invention to the above-mentioned configuration, wherein the periphery of the first dielectric layer 7 is covered with the sealing member 30, can prevent blisters and burst parts from occurring on the periphery of first dielectric layer 7, thereby enabling the aforementioned problems to be controlled.

Although the above section describes a case wherein the first dielectric layer 7 is in a two-layer structure, even for a multilayered structure with two or more layers, repeating the above-mentioned forming method enables forming layers in the same way.

In addition, the present invention is also applicable to the second dielectric layer 12 covering the data electrode 11 on the back panel 9, allowing similar effects as described above to be achieved.

INDUSTRIAL APPLICABILITY

The present invention enables implementation of a plasma display panel with dielectric layers with an excellent characteristic of breakdown voltage by restricting bubbles that are generated on the peripheries of the dielectric layers, to be applied to a plasma display device, for example, that displays favorable images.

The invention claimed is:

1. A plasma display panel comprising:

a front substrate;

a back substrate;

a display electrode provided on said front substrate and formed of a scanning electrode and a sustain electrode;

a data electrode provided on said back substrate;

a multilayered first dielectric layer for covering said display electrode;

a multilayered second dielectric layer for covering said data electrode; and a sealing member for sealing said plasma display panel, said sealing member intervening between said front substrate and said back substrate arranged so as to face each other;

wherein at least one of a periphery of an upper dielectric layer of said first dielectric layer is positioned partially in size and shape to a periphery of a lower dielectric layer of said first dielectric layer, and a periphery of an upper dielectric layer of said second dielectric layer is positioned partially in size and shape to a periphery of a lower dielectric layer of said second dielectric layer; and wherein the periphery of said first dielectric layer is covered with said sealing member.

* * * * *